US008831490B2

(12) United States Patent
Inagaki

(10) Patent No.: US 8,831,490 B2
(45) Date of Patent: Sep. 9, 2014

(54) ENDLESS BELT FOR IMAGE-FORMING APPARATUS, ENDLESS BELT UNIT, IMAGE-FORMING APPARATUS, AND METHOD FOR FORMING IMAGE

(75) Inventor: Tomotake Inagaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 98 days.

(21) Appl. No.: 13/593,166

(22) Filed: Aug. 23, 2012

(65) Prior Publication Data

US 2013/0236218 A1 Sep. 12, 2013

(30) Foreign Application Priority Data

Mar. 7, 2012 (JP) ..... 2012-050880

(51) Int. Cl.
*G03G 15/16* (2006.01)

(52) U.S. Cl.
CPC ..... *G03G 15/162* (2013.01)
USPC ..... 399/302; 399/303

(58) Field of Classification Search
CPC ..... G03G 15/0131; G03G 15/0189; G03G 15/162
USPC ..... 399/302, 303, 308, 313, 307
See application file for complete search history.

(56) References Cited

U.S. PATENT DOCUMENTS

| | | | | |
|---|---|---|---|---|
| 2008/0102390 | A1 | 5/2008 | Inagaki et al. | |
| 2011/0003118 | A1* | 1/2011 | Ohtsu et al. | 399/302 X |
| 2011/0110686 | A1* | 5/2011 | Yoshino et al. | 399/302 X |
| 2011/0293824 | A1* | 12/2011 | Aoto et al. | 399/302 X |
| 2012/0051802 | A1* | 3/2012 | Inagaki et al. | 399/302 |
| 2012/0243907 | A1* | 9/2012 | Inagaki et al. | 399/302 X |

FOREIGN PATENT DOCUMENTS

| | | | |
|---|---|---|---|
| JP | 10-186892 | A | 7/1998 |
| JP | 2001-092268 | A | 4/2001 |
| JP | 2001-350355 | A | 12/2001 |
| JP | 2005-156955 | A * | 6/2005 |
| JP | 2008-107729 | A | 5/2008 |
| JP | 2010-158646 | A | 7/2010 |
| JP | 2011-000795 | A | 1/2011 |

* cited by examiner

*Primary Examiner* — Sophia S Chen
(74) *Attorney, Agent, or Firm* — Sughrue Mion, PLLC

(57) ABSTRACT

An endless belt for an image-forming apparatus includes, as an outermost layer, a resin layer having substantially hemispherical protrusions distributed over an outer surface thereof.

9 Claims, 5 Drawing Sheets

ENDLESS BELT FOR IMAGE-FORMING APPARATUS, ENDLESS BELT UNIT, IMAGE-FORMING APPARATUS, AND METHOD FOR FORMING IMAGE

CROSS-REFERENCE TO RELATED APPLICATIONS

This application is based on and claims priority under 35 USC 119 from Japanese Patent Application No. 2012-050880 filed Mar. 7, 2012.

BACKGROUND

Technical Field

The present invention relates to endless belts for image-forming apparatuses, endless belt units, image-forming apparatuses, and methods for forming images.

SUMMARY

According to an aspect of the invention, there is provided an endless belt for an image-forming apparatus. The endless belt includes, as an outermost layer, a resin layer having substantially hemispherical protrusions distributed over an outer surface thereof.

BRIEF DESCRIPTION OF THE DRAWINGS

Exemplary embodiments of the present invention will be described in detail based on the following figures, wherein.

DETAILED DESCRIPTION

Exemplary embodiments will now be described in detail with reference to the drawings.

A small-sized toner (e.g., a toner having a volume average particle size of 2.0 to 6.5 μm) used for image formation has low transfer efficiency because its small particle size results in a small amount of charge. This is presumably because the small particle size results in a small difference between attraction in an electric field and belt-toner adhesion. The transfer efficiency is particularly lower for use with recording media, such as paper, having rough surfaces.

After considerable research, the inventor has discovered that an endless belt including a resin layer having hemispherical or substantially hemispherical protrusions distributed over the outer surface thereof may maintain its high transfer performance after repeated transfer of images of a small-sized toner to rough paper for an extended period of time. The mechanism is believed to be as follows.

An endless belt having irregular protrusions distributed over the outer surface thereof by adding particles thereto could initially transfer a small-sized toner to rough paper more efficiently than an endless belt having no such protrusions. After repeated image formation, however, such an endless belt often exhibits decreased transfer performance as a result of wear, chipping, and release of the protrusions due to contact with another member such as an image carrier or cleaning member.

In contrast, an endless belt having hemispherical or substantially hemispherical protrusions distributed over the outer surface thereof may have a smaller belt-toner contact area and thus have a lower belt-toner adhesion than an endless belt having irregular protrusions distributed over the outer surface thereof. This may allow a small-sized toner to be more efficiently transferred to rough paper. In addition, the hemispherical protrusions may be more resistant to wear, chipping, and release due to contact with another member. This may allow the endless belt to maintain its high releasability (e.g., high toner transfer performance).

Endless Belt

An endless belt according to an exemplary embodiment includes, as the outermost layer, a resin layer having hemispherical or substantially hemispherical protrusions distributed over the outer surface thereof.

Figure 1:
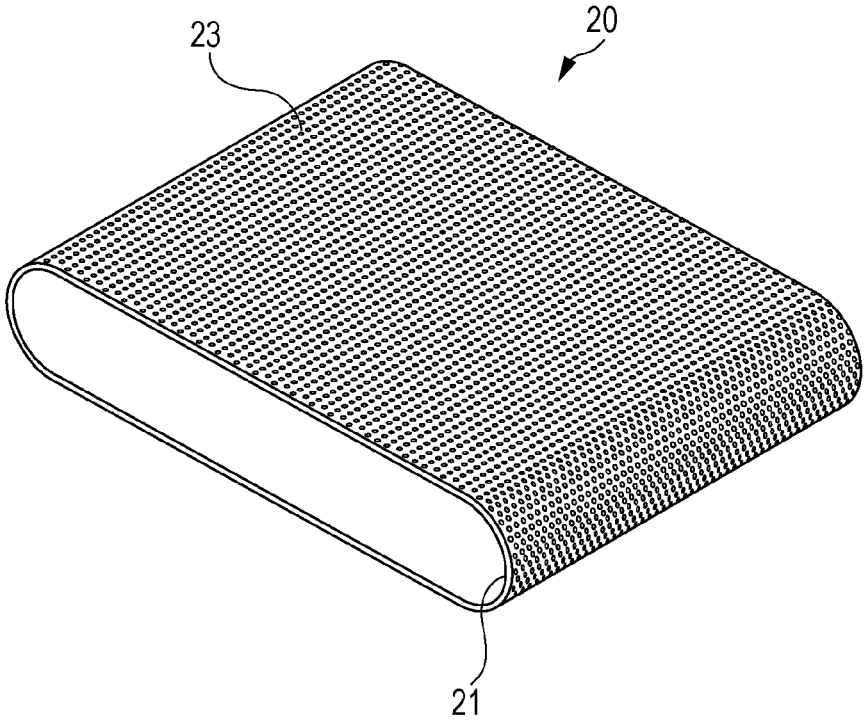
FIG. 1 is a schematic perspective view illustrating an example of an endless belt according to an exemplary embodiment.
Figure 2:
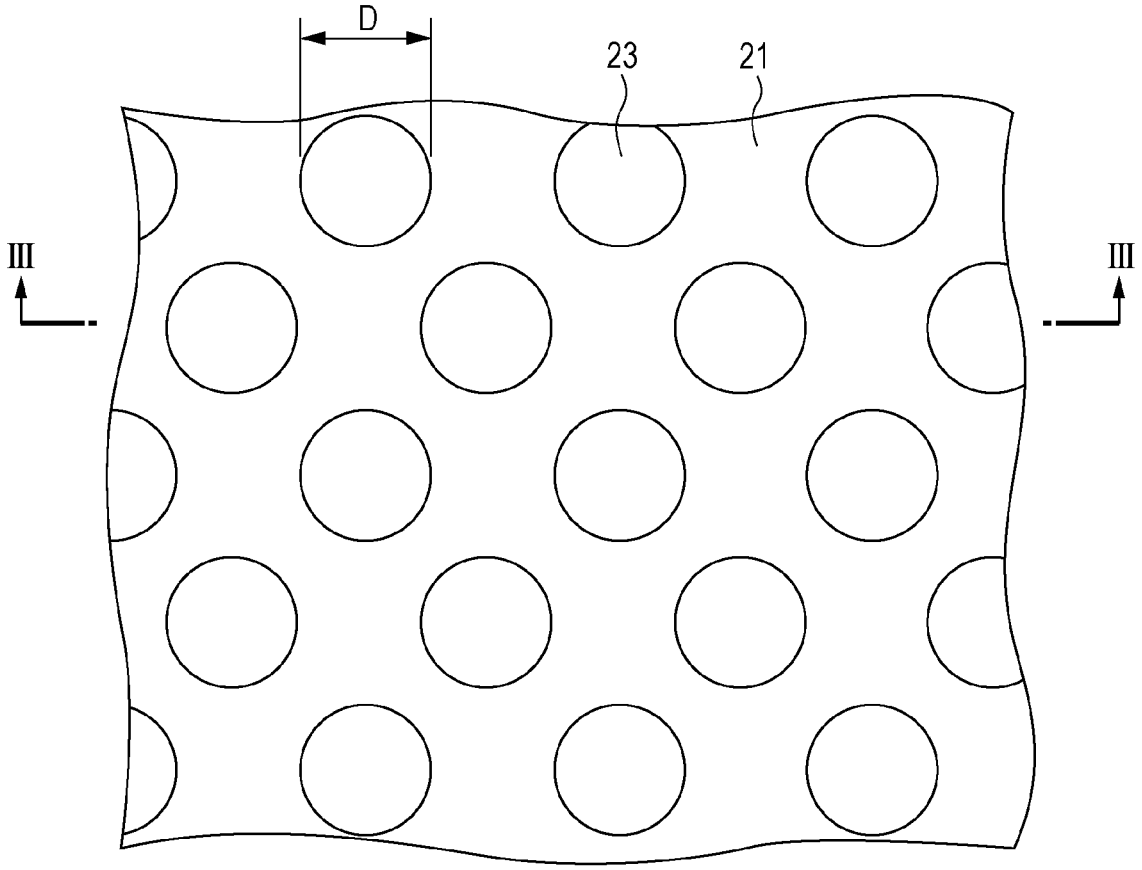
FIG. 2 is a plan view illustrating an example of a pattern of hemispherical or substantially hemispherical protrusions distributed over the outer surface of the endless belt.
Figure 3:
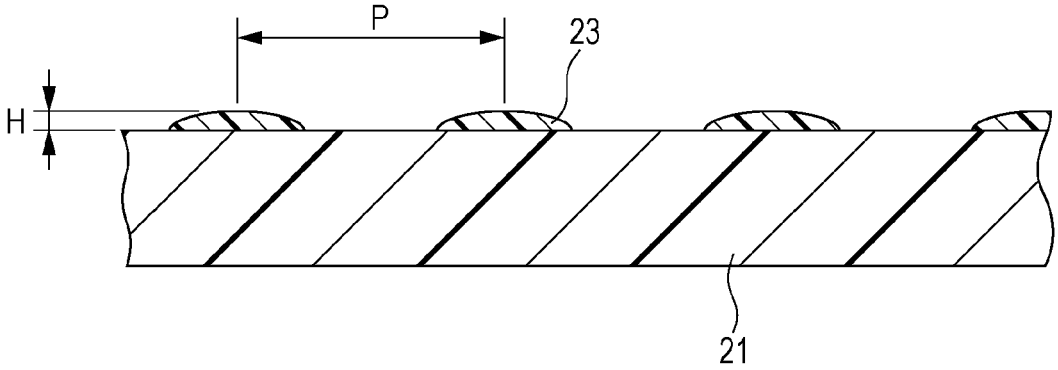
FIG. 3 is a sectional view taken along line III-III of FIG. 2.

FIG. 1 is a schematic perspective view illustrating an example of an endless belt according to this exemplary embodiment. FIG. 2 is a plan view showing, in an enlarged view, part of the outer surface of the endless belt according to this exemplary embodiment. FIG. 3 is a sectional view taken along line III-III of FIG. 2.

An endless belt 20 according to this exemplary embodiment includes, as the outermost layer, a resin layer (substrate layer) 21 containing a resin and having hemispherical or substantially hemispherical protrusions 23 distributed over the outer surface thereof. The description herein will concentrate on the use of the endless belt 20 according to this exemplary embodiment as an intermediate transfer belt for electrophotographic image-forming apparatuses, although the endless belt 20 is not limited to any particular use.

Substrate Layer

The substrate layer 21 may have any thickness, depending on the use of the endless belt 20. If the endless belt 20 is used as an intermediate transfer belt, the substrate layer 21 may have a thickness of, for example, 30 to 80 μm.

The substrate layer 21 contains a resin, and optionally contains a conductor and other additives.

Examples of resins used for the substrate layer 21 include polyimide resins, fluorinated polyimide resins, polyamide resins, polyamideimide resins, polyetheretherester resins, polyarylate resins, polyester resins, and reinforced polyester resins.

The resin used for the substrate layer 21 may be a thermosetting resin such as a polyimide resin. Polyimide resins, having high Young's modulus, are more resistant to deformation than other resins during operation (under a stress exerted by another member such as a support roller or cleaning blade). The use of a polyimide resin provides an endless belt (intermediate transfer belt) that causes few image defects such as color shifts.

The polyimide resin is, for example, an imide derivative of a polyamic acid, i.e., a polymer of a tetracarboxylic dianhydride and a diamine. The polyimide resin is prepared by, for example, polymerizing equimolar amounts of a tetracarboxylic dianhydride and a diamine in a solvent and imidizing the resulting polyamic acid in the solution.

An example of a tetracarboxylic dianhydride is represented by general formula (I):

General Formula (I)

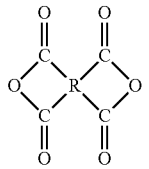

(where R is a tetravalent organic group selected from the group consisting of aromatic groups, aliphatic groups, alicyclic groups, combinations of aromatic and aliphatic groups, and substituted derivatives thereof).

Examples of tetracarboxylic dianhydrides include pyromellitic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)sulfonic dianhydride, perylene-3,4,9,10-tetracarboxylic dianhydride, bis(3,4-dicarboxyphenyl)ether dianhydride, and ethylenetetracarboxylic dianhydride.

Examples of diamines include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenylsulfone, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminodiphenylsulfone, 4,4'-diaminodiphenylpropane, 2,4-bis(β-amino-t-butyl)toluene, bis(p-β-amino-t-butylphenyl)ether, bis(p-β-methyl-δ-aminophenyl)benzene, bis-p-(1,1-dimethyl-5-aminobenzyl)benzene, 1-isopropyl-2,4-m-phenylenediamine, m-xylylenediamine, p-xylylenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

The solvent used for polymerization of the tetracarboxylic dianhydride and the diamine may be, for example, a polar solvent (organic polar solvent), which provides good solubility. Examples of polar solvents include N,N-dialkylamides (e.g., low-molecular-weight N,N-dialkylamides such as N,N-dimethylformamide, N,N-dimethylacetoamide, N,N-diethylformamide, N,N-diethylacetoamide, and N,N-dimethylmethoxyacetoamide), dimethyl sulfoxide, hexamethylphosphortriamide, N-methyl-2-pyrrolidone, pyridine, tetramethylenesulfone, and dimethyltetramethylenesulfone. Such solvents may be used alone or in combination.

The content of the polyimide resin is, for example, 10% to 80% by mass, preferably 20% to 75% by mass, more preferably 40% to 70% by mass, of the total amount of components of the substrate layer 21.

The substrate layer 21 may contain either a single polyimide resin or a combination of two or more polyimide resins.

Examples of conductors include conductive (e.g., a volume resistivity of less than $10^7$ Ω·cm; the same applies hereinafter) or semiconductive (e.g., a volume resistivity of $10^7$ to $10^{13}$ Ω·cm; the same applies hereinafter) powders (e.g., powders composed of particles having primary particle sizes of less than 10 μm, preferably 1 μm or less).

Examples of conductors include, but not limited to, carbon black (e.g., Ketjenblack, acetylene black, and surface-oxidized carbon black), metals (e.g., aluminum and nickel), metal oxides (e.g., yttrium oxide and tin oxide), ionic conductors (e.g., potassium titanate and LiCl), and polymer conductors (e.g., polyaniline, polypyrrole, polysulfone, and polyacetylene).

The conductor is selected depending on the purpose thereof. For high electrical resistance stability over time and low electric field dependence, which alleviates electric field concentration due to transfer voltage, the conductor may be oxidized carbon black (e.g., carbon black surface-modified with a functional group such as carboxyl, quinone, lactone, or hydroxyl) having a pH of 5 or less (preferably 4.5 or less, more preferably 4.0 or less). For high electrical durability, the conductor may be a polymer conductor (e.g., polyaniline).

If the endless belt 20 according to this exemplary embodiment is used as an intermediate transfer belt, the content of the conductor is, for example, 1% to 50% by mass, preferably 2% to 40% by mass, more preferably 4% to 30% by mass, of the total amount of components of the substrate layer 21.

The substrate layer 21 may contain either a single conductor or a combination of two or more conductors.

The substrate layer 21 may be a single layer or a laminate of two or more layers. For example, another resin layer may be disposed as the outermost layer on the substrate layer 21, and the hemispherical protrusions 23 may be distributed over the outer surface of the outermost resin layer.

If the endless belt 20 according to this exemplary embodiment is a laminate of two or more layers, the same resin may be used for these layers to prevent delamination. For example, a laminate of layers containing a polyimide resin may have high adhesion, may be more resistant to deformation than other resins during belt rotation, and may form an endless belt having high transfer performance.

Hemispherical Protrusions

The hemispherical protrusions 23 protrude in a hemispherical or substantially hemispherical shape from the flat surface of the substrate layer 21 and have curved surfaces.

As used herein, the term "hemispherical" does not necessarily means exactly a half of a perfect sphere divided in a plane passing through the center thereof; it means any shape having a partially missing circular or oval cross-section. To ensure high toner transfer performance and to reduce release and wear due to contact with another member such as a cleaning member, the hemispherical protrusions 23 preferably have a shape that is a half of a sphere or smaller, more preferably one twentieth to one half.

For improved adhesion to the substrate layer 21, the hemispherical protrusions 23 may be formed using the same resin used for the substrate layer 21, e.g., a polyimide resin.

For improved transfer performance, the hemispherical protrusions 23 preferably contain a fluorinated material, which has low surface energy, more preferably a fluoropolymer resin, most preferably a fluorinated polyimide.

The endless belt 20 according to this exemplary embodiment, having the hemispherical protrusions 23 distributed over the outer surface thereof, may have a small belt-toner contact area and thus have a low belt-toner adhesion. In addition, the use of a material having low adhesion for the hemispherical protrusions 23 may afford a still lower adhesion. The combined effect of the shape of the protrusions 23 distributed over the outer surface and the material used therefor may allow a small-sized toner, which has low chargeability, to be smoothly transferred to a recording medium, particularly to rough paper.

If the endless belt 20 according to this exemplary embodiment is used as an intermediate transfer member, the hemispherical protrusions 23 may contain a conductor such as carbon black. Protrusions containing no conductor might cause discharge in a transfer section, thus resulting in poor transfer.

The content of carbon black in the hemispherical protrusions 23 is, for example, 3% to 40% by mass, preferably 5% to 35% by mass, more preferably 7% to 30%, of the total amount of components of the hemispherical protrusions 23, depending on the content of carbon black in the substrate layer 21.

For high image quality, the content of carbon black in the hemispherical protrusions 23 may be lower than the content of carbon black in the substrate layer 21. If the content of carbon black in the hemispherical protrusions 23 is higher than the content of carbon black in the substrate layer 21, a current might flow preferentially through the protrusions in a transfer section.

Hemispherical protrusions of insufficient size (width D and height H) would provide a limited improvement in transfer performance, whereas hemispherical protrusions of excessive size wound decrease the cleaning performance and provide a limited improvement in transfer performance. To maintain the cleaning performance while ensuring high transfer performance, the width (diameter) D and height H of the hemispherical protrusions 23 are preferably 0.05 to 5 times, more preferably 0.1 to 3 times, the volume average particle size (D50v) of the toner particles used.

The width (diameter) D of the hemispherical protrusions 23 may be set depending on the size of the toner particles used. To maintain the cleaning performance while ensuring high transfer performance, for example, if the volume average particle size (D50v) of the toner particles is 2.0 to 6.5 μm, the width (diameter) D of the hemispherical protrusions 23 in plan view, as shown in FIG. 2, may be 0.05 to 20 μm, preferably 0.1 to 15 μm, more preferably 0.2 to 10 μm.

Again, the height H of the hemispherical protrusions 23 may be set depending on the volume average particle size of the toner particles used. To maintain the cleaning performance while ensuring high transfer performance, for example, the height H of the hemispherical protrusions 23 may be 0.05 to 20 μm, preferably 0.1 to 15 μm, more preferably 0.2 to 10 μm.

The width (diameter) D and height H of the hemispherical protrusions 23 are determined as follows. A sample is taken from the substrate layer 21 of the endless belt 20. The sample is examined under a scanning electron microscope (SEM) or atomic force microscope (AFM). The widths and heights of any 10 hemispherical protrusions 23 are measured and averaged.

The pitch of the hemispherical protrusions 23 may be set depending on the width (diameter) D and height H of the hemispherical protrusions 23 and the size of the toner particles used. To maintain the cleaning performance while ensuring high transfer performance, the coverage of the outer surface of the substrate layer 21 (i.e., the total area of the hemispherical protrusions 23 divided by the area of the region where the hemispherical protrusions 23 are disposed) is preferably 5% to 50%, more preferably 10% to 40%. A coverage of 5% or more may allow for a small contact area between the toner particles and the substrate layer 21, thus maintaining the transfer performance. A coverage of 50% or less may allow the adjacent hemispherical protrusions 23 to be spaced apart from each other so that they are not smoothened as a result of wear or loss during the rotation of the belt 20.

In particular, the pitch P of the adjacent hemispherical protrusions 23 (the distance between the apexes of the adjacent hemispherical protrusions 23), as shown in FIG. 3, may be smaller than the volume average particle size of the toner particles used. A pitch P smaller than the size of the toner particles may reduce contact between the toner particles and the substrate layer 21, thus ensuring high transfer performance.

The number density (abundance) of the hemispherical protrusions 23 is, for example, 100 to 1,000,000 protrusions, preferably 500 to 800,000 protrusions, more preferably 1,000 to 500,000 protrusions, per 0.01 $mm^2$.

The number density of the hemispherical protrusions 23 is determined as follows. A sample is taken from the substrate layer 21 of the endless belt 20. The sample is examined under SEM. The numbers of hemispherical protrusions 23 in any 10 regions (having an area of 0.01 $mm^2$) are measured and averaged.

The hemispherical protrusions 23 may be provided on the outer surface of the endless belt 20 in any manner, either regularly or irregularly. To reduce variations in transfer performance over the entire endless belt 20, the hemispherical protrusions 23 may be regularly arranged at a predetermined pitch, for example, as shown in FIG. 2.

Method for Manufacturing Endless Belt

A method for manufacturing the endless belt 20 according to this exemplary embodiment will now be described. The endless belt 20 may be manufactured in any manner. For example, the hemispherical protrusions 23 may be formed on an uncured film that is to form the substrate layer 21 using a material that is the same as or different from the substrate layer 21 before or after the film is cured to form the substrate layer 21.

For example, films that are to form the hemispherical protrusions 23 may be formed on a polyimide precursor film that is to form the substrate layer 21 using a fluorinated thermosetting resin by an inkjet process before imidation. A subsequent thermosetting reaction may improve the adhesion between the substrate layer 21 and the hemispherical protrusions 23 and ensure high transfer performance.

The method for manufacturing the endless belt 20 described herein uses a polyimide resin and carbon black for the substrate layer 21 and the hemispherical protrusions 23, although other resins and conductors may be used.

The core is prepared first. The core is, for example, a cylindrical die. The core is made of, for example, a metal such as aluminum, stainless steel, or nickel. The core requires a length larger than or equal to that of the intended endless belt 20. The core may be 10% to 40% longer than the intended endless belt 20.

As a coating solution for forming the substrate layer 21, a polyamic acid solution having carbon black dispersed therein is prepared.

For example, a polyamic acid solution having carbon black dispersed therein is prepared by dissolving a tetracarboxylic dianhydride and a diamine in an organic polar solvent, dispersing carbon black therein, and facilitating polymerization.

The monomer concentrations of the polyamic acid solution (the concentrations of the tetracarboxylic dianhydride and the diamine in the solvent) may be 5% to 30% by mass, depending on various conditions. The polymerization temperature is preferably set to 80° C. or lower, more preferably 5° C. to 50° C. The polymerization time may be 5 to 10 hours.

The coating solution for forming the substrate layer 21 is applied to the cylindrical die provided as the core to form a coating of the coating solution for forming the substrate layer 21.

The coating solution may be applied to the cylindrical die in any manner. For example, the outer surface of the cylindrical die may be dipped in the coating solution, the coating solution may be applied to the inner surface of the cylindrical die, or the coating solution may be applied to the outer or inner surface of the cylindrical die while rotating the die with the axis thereof being horizontal (i.e., spiral coating or die coating).

The coating of the coating solution for forming the substrate layer 21 is dried to form a film that is to form the substrate layer 21 (dry film before imidation). The coating may be dried, for example, at 80° C. to 200° C. for 10 to 60 minutes, which may be shortened at higher temperatures. It is also effective to blow hot air during heating. The heating temperature may be raised stepwise or at a constant rate. The core may be rotated at 5 to 60 rpm with the axis thereof being horizontal. After drying, the core may be placed vertically.

As a coating solution for forming the hemispherical protrusions 23, for example, a polyamic acid solution having carbon black dispersed therein is prepared.

For example, a polyamic acid solution having carbon black dispersed therein is prepared by dissolving a tetracarboxylic dianhydride and a diamine in an organic polar solvent, dispersing carbon black therein, and facilitating polymerization.

The monomer concentrations of the polyamic acid solution and the polymerization temperature and time may be similar to those for the coating solution for forming the substrate layer 21. The polyamic acid may be fluorinated.

The coating solution for forming the hemispherical protrusions 23 is ejected as droplets onto the film that is to form the substrate layer 21. The coating solution may be ejected as droplets onto the film that is to form the substrate layer 21 in any manner using any apparatus. For example, the size and pitch of the droplets that are to form the hemispherical protrusions 23 may be appropriately controlled in an inkjet process using, for example, an inkjet droplet-ejecting head disclosed in Japanese Unexamined Patent Application Publication No. 2008-107729 or a droplet-ejecting apparatus disclosed in Japanese Unexamined Patent Application Publication No. 2010-158646.

Figure 4:
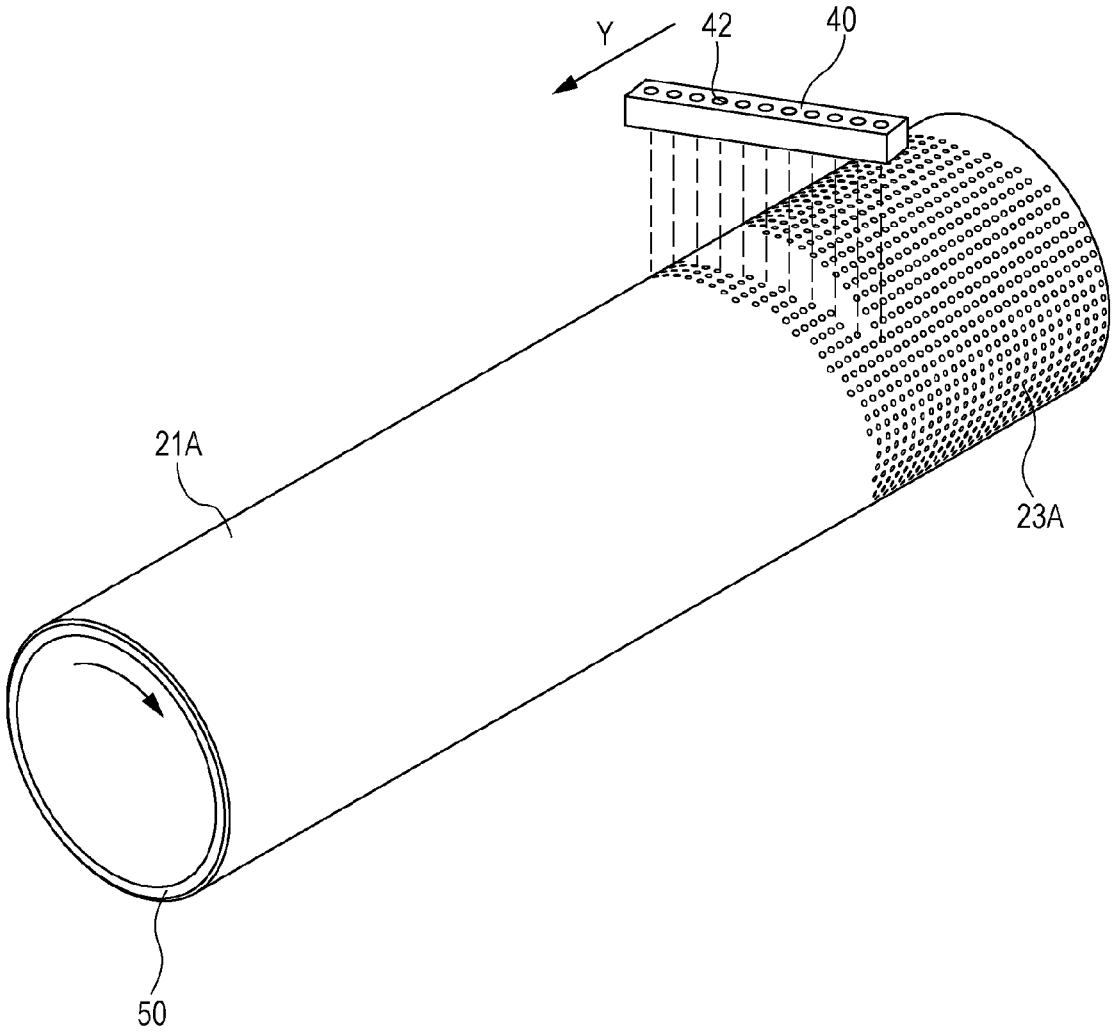
FIG. 4 is a schematic view illustrating an example of an inkjet process for forming the hemispherical protrusions of the endless belt according to the exemplary embodiment.

FIG. 4 illustrates an example of an inkjet process for ejecting the coating solution for forming the hemispherical protrusions 23 as droplets onto the film that is to form the substrate layer 21. As shown in FIG. 4, the coating solution for forming the hemispherical protrusions 23 is ejected as droplets 23A onto a film 21A that is to form the substrate layer 21 on the outer surface of a core 50 using an inkjet droplet-ejecting head 40 having orifices 42 such that the droplets 23A do not overlap each other. During this process, for example, the core 50 is rotated in one direction about the axis thereof (Y in FIG. 4). The coating solution for forming the hemispherical protrusions 23 is ejected as the droplets 23A from the orifices 42 of the inkjet droplet-ejecting head 40 onto the film 21A. The direction in which the orifices 42 are arranged is inclined relative to the direction of the axis of rotation of the core 50. At the same time, the inkjet droplet-ejecting head 40 is moved in the direction of the axis of rotation of the core 50. As a result, the droplets 23A are ejected onto the film 21A in a spiral pattern so as not to overlap each other. One movement of the inkjet droplet-ejecting head 40 in the direction of the axis of rotation of the core 50 allows the droplets (coatings) 23A for forming the hemispherical protrusions 23 to be distributed over the entire film 40A.

The coatings 23A for forming the hemispherical protrusions 23 are dried to form films that are to form the hemispherical protrusions 23 (dry films before imidation). The drying conditions may be similar to those for the coating of the coating solution for forming the substrate layer 21.

The film 21A that is to form the substrate layer 21 and the films that are to form the hemispherical protrusions 23 are subjected to imidation treatment (baking).

The imidation treatment (baking) involves heating the films, for example, at 250° C. to 450° C. (preferably 300° C. to 350° C.) for 20 to 60 minutes to facilitate imidation reaction, thus forming a polyimide resin film. The heating temperature may be raised stepwise or gradually at a constant rate before reaching the final temperature.

For improved adhesion between the substrate layer 21 and the hemispherical protrusions 23, the film 21A that is to form the substrate layer 21 and the films that are to form the hemispherical protrusions 23 may be simultaneously subjected to imidation treatment (baking). Alternatively, the film 21A that is to form the substrate layer 21 may be subjected to imidation treatment (baking) to form the substrate layer 21 before the coating solution for forming the hemispherical protrusions 23 is applied, dried, and baked to form the hemispherical protrusions 23.

After the imidation treatment (baking), the film is removed from the core 50. Thus, the endless belt 20 is obtained, which has the hemispherical protrusions 23 distributed over the substrate layer 21.

The endless belt 20 may be manufactured in any other manner. For example, the hemispherical protrusions 23 may be formed by pressing a template having hemispherical recesses distributed over the surface thereof against the film 21A that is to form the substrate layer 21. Alternatively, the coating solution for forming the substrate layer 21 may be applied to an inner surface of a cylindrical core over which hemispherical recesses are distributed and be dried, baked, and removed.

Although the endless belt 20 according to this exemplary embodiment is illustrated as including the single substrate layer 21 having the hemispherical protrusions 23 distributed over the outer surface thereof, it may take any other form including a resin layer having the hemispherical protrusions 23, which have curved surfaces, distributed over the outermost surface thereof. For example, the endless belt 20 may be a laminate of two or more layers (e.g., a laminate of the substrate layer 21 and a surface layer disposed thereon and having the hemispherical protrusions 23 distributed over the surface thereof, or a laminate of two or more substrate layers 21).

The endless belt 20 according to this exemplary embodiment may be used alone or in combination with other members. For example, the endless belt 20 may be used as a roller unit including rollers supporting the inner surface of the endless belt 20.

The endless belt 20 according to this exemplary embodiment is not necessarily used as an intermediate transfer belt for image-forming apparatuses. For example, the endless belt 20 may be used as other belts for image-forming apparatuses, including fixing belts and transport belts.

Endless Belt Unit

Figure 5:
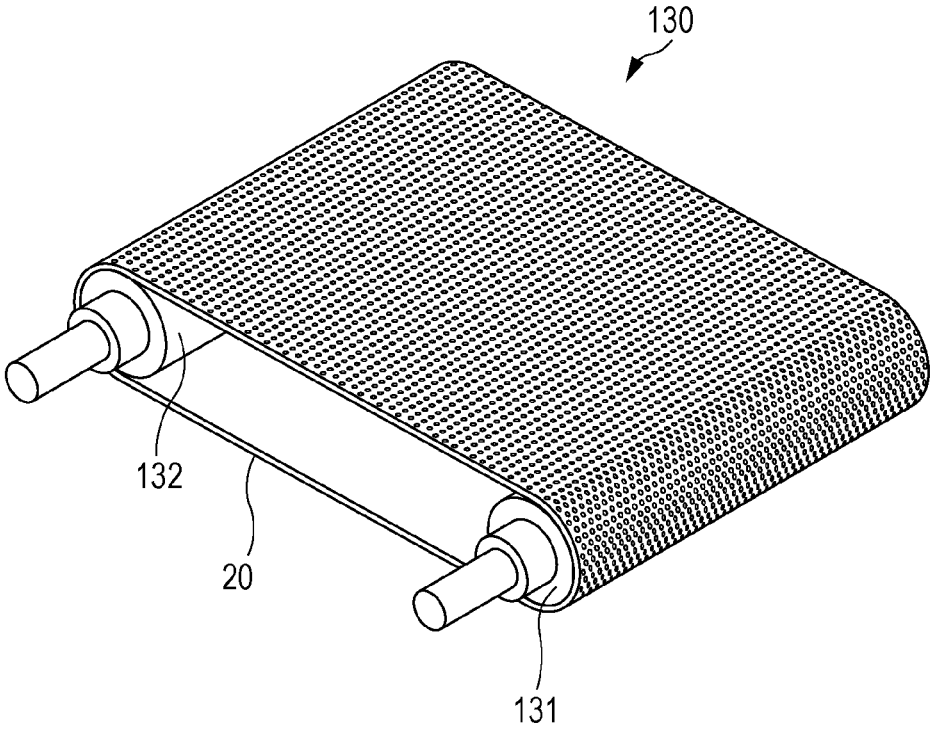
FIG. 5 is a schematic perspective view illustrating an example of an endless belt unit according to an exemplary embodiment.

FIG. 5 is a schematic perspective view illustrating an example of an endless belt unit according to an exemplary embodiment.

As shown in FIG. 5, an endless belt unit 130 according to an exemplary embodiment includes the endless belt (intermediate transfer belt) 20 according to the above exemplary embodiment as a belt member. For example, the endless belt 20 is entrained about a drive roller 131 and a driven roller 132 disposed opposite each other under tension.

The endless belt unit 130 according to this exemplary embodiment is also provided with other rollers about which the endless belt 20 is entrained for use as an intermediate transfer belt. Such rollers include a roller for first transfer of a toner image from the surface of a photoreceptor (e.g., an image carrier) to the endless belt 20 and a roller for second transfer of the toner image from the endless belt 20 to a recording medium.

The endless belt 20 may be entrained about any number of rollers, depending on the manner in which the endless belt 20 is used. The endless belt unit 130 is incorporated and used in a system in which the endless belt 20 is entrained about and rotated by the drive roller 131 and the driven roller 132.

Image-Forming Apparatus

An image-forming apparatus according to an exemplary embodiment includes an image carrier having a surface, a charging unit that charges the surface of the image carrier, a latent-image forming unit that forms an electrostatic latent image on the surface of the image carrier, a developing unit that contains a developer containing toner particles and that develops the electrostatic latent image with the developer to form a toner image, a transfer unit that transfers the toner image from the surface of the image carrier to a recording medium, and a fixing unit that fixes the toner image to the recording medium. The transfer unit includes the endless belt 20 according to the above exemplary embodiment as an intermediate transfer member.

For example, the transfer unit of the image-forming apparatus according to this exemplary embodiment includes an intermediate transfer member, a first transfer unit that transfers the toner image from the image carrier to the intermediate transfer member, and a second transfer unit that transfers the toner image from the intermediate transfer member to the recording medium. The transfer unit includes the endless belt 20 according to the above exemplary embodiment as the intermediate transfer member.

The image-forming apparatus according to this exemplary embodiment may be, for example, a monochrome image-forming apparatus including a developing device containing a monochrome toner, a color image-forming apparatus that sequentially transfers toner images from image carriers to an intermediate transfer member, or a tandem color image-forming apparatus in which image carriers provided with developing devices for different colors are arranged in tandem along the intermediate transfer member.

Figure 6:
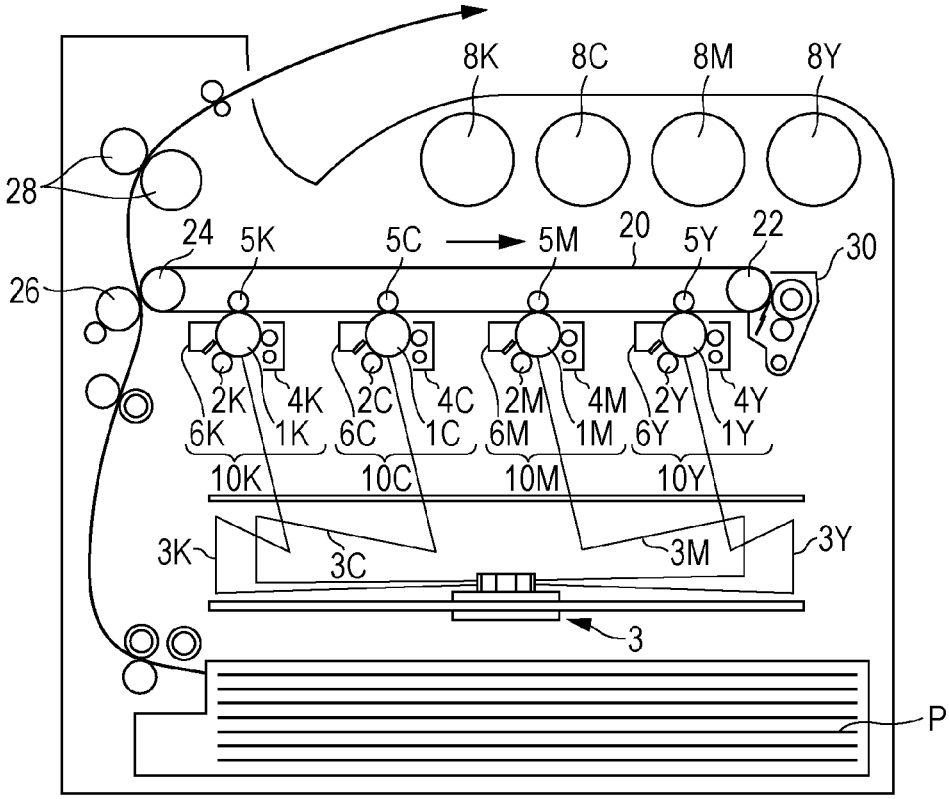
FIG. 6 is a schematic view illustrating an example of an image-forming apparatus according to an exemplary embodiment.

The image-forming apparatus according to this exemplary embodiment will now be described with reference to the drawings. FIG. 6 is a schematic view illustrating an example of an image-forming apparatus according to this exemplary embodiment.

The image-forming apparatus illustrated in FIG. 6 includes first to fourth electrophotographic image-forming units 10Y, 10M, 10C, and 10K that produce yellow (Y), magenta (M), cyan (C), and black (K) images, respectively, based on color separation image data. The image-forming units (hereinafter "units") 10Y, 10M, 10C, and 10K are arranged in parallel at a particular spacing in the horizontal direction. The units 10Y, 10M, 10C, and 10K may also be process cartridges attachable to and detachable from the image-forming apparatus.

An intermediate transfer belt 20, provided as an intermediate transfer member, extends over the units 10Y, 10M, 10C, and 10K in FIG. 6. The intermediate transfer belt 20 is entrained about a drive roller 22 and a support roller 24 spaced apart from each other in the direction from the left to the right in FIG. 6 and disposed in contact with the inner surface of the intermediate transfer belt 20. The transfer unit of the image-forming apparatus is configured such that the intermediate transfer belt 20 travels in the direction from the first unit 10Y toward the fourth unit 10K.

A spring (not shown), for example, biases the support roller 24 in the direction away from the drive roller 22 to apply a particular tension to the intermediate transfer belt 20 entrained about the two rollers 22 and 24. An intermediate-transfer-member cleaning device 30 is disposed opposite the drive roller 22 on the image carrier side of the intermediate transfer belt 20.

The units 10Y, 10M, 10C, and 10K include developing devices (developing units) 4Y, 4M, 4C, and 4K, respectively, to which yellow, magenta, cyan, and black toners can be supplied from toner cartridges 8Y, 8M, 8C, and 8K, respectively.

Whereas a toner of any particle shape and size may be used in this exemplary embodiment, a small-sized toner (e.g., a toner having a volume average particle size (D50v) of 2.0 to 6.5 μm) may be used because the intermediate transfer belt 20 has high releasability (toner transfer performance).

The volume average particle size of the toner particles is measured as follows. To 2 mL of an aqueous solution containing 5% by mass of a surfactant such as sodium alkylbenzenesulfonate, which is used as a dispersant, 0.5 to 50 mg of specimen is added, and the solution is added to 100 to 150 mL of the electrolytic solution. The electrolytic solution having the specimen suspended therein is subjected to dispersion treatment using a sonicator for one minute. The particle size distribution is measured for particles having particle sizes of 2.0 to 60 μm using a Coulter Multisizer II particle size analyzer (from Beckman Coulter, Inc.) with an aperture having an aperture size of 100 μm. A total of 50,000 particles are analyzed.

The particle size distribution thus obtained is divided into particle size ranges (channels). The particle size at which subtracting the cumulative volume distribution from the smaller particle size side gives a cumulative volume of 50% is determined as the volume average particle size (D50v).

The first to fourth units 10Y, 10M, 10C, and 10K have the same structure. The description herein will concentrate on the first unit 10Y, which is located upstream in the travel direction of the intermediate transfer belt 20 and which forms a yellow image. The elements of the second to fourth units 4M, 4C, and 4K corresponding to those of the first unit 10Y are designated by like numerals followed by "M" (magenta), "C" (cyan), and "K" (black), respectively, rather than "Y" (yellow), and are not further described herein.

The first unit 10Y includes a photoreceptor 1Y that functions as an image carrier. The photoreceptor 1Y is surrounded by, in sequence, a charging roller 2Y that charges the surface of the photoreceptor 1Y to a particular potential, an exposure device 3 that exposes the charged surface to a laser beam 3Y based on a color separation image signal to form an electrostatic image, a developing device (developing unit) 4Y that supplies a charged toner to the electrostatic image to develop the electrostatic image, a first transfer roller (first transfer unit) 5Y that transfers the developed image to the intermediate transfer belt 20, and a photoreceptor-cleaning device (cleaning unit) 6Y that removes residual toner from the surface of the photoreceptor 1Y with a cleaning blade after the first transfer.

The first transfer roller 5Y is disposed opposite the photoreceptor 1Y inside the intermediate transfer belt 20. The first transfer rollers 5Y, 5M, 5C, and 5K have connected thereto bias power supplies (not shown) that apply a first transfer bias thereto. A controller (not shown) controls the bias power supplies to change the transfer bias applied to the first transfer rollers 5Y, 5M, 5C, and 5K.

The image-forming operation of the first unit 10Y will now be described. Before the operation, the charging roller 2Y charges the surface of the photoreceptor 1Y to a potential of about −600 to about −800 V.

The photoreceptor 1Y includes a conductive substrate (having a volume resistivity at 20° C. of $1\times10^6$ Ωcm or less) and a photosensitive layer disposed on the substrate. The photosensitive layer, which normally has high resistivity (comparable to the resistivity of common resins), has the property of changing its resistivity in a region irradiated with the laser beam 3Y. The exposure device 3 directs the laser beam 3Y onto the charged surface of the photoreceptor 1Y based on yellow image data received from the controller (not shown). The laser beam 3Y irradiates the photosensitive layer of the photoreceptor 1Y to form an electrostatic image with a yellow print pattern on the surface of the photoreceptor 1Y.

The electrostatic image is an image formed by the charge on the surface of the photoreceptor 1Y. Specifically, the electrostatic image is a negative latent image formed on the surface of the photoreceptor 1Y after the charge dissipates from the region irradiated with the laser beam 3Y, where the resistivity drops, while remaining in the region not irradiated with the laser beam 3Y.

As the photoreceptor 1Y rotates, the electrostatic image formed on the photoreceptor 1Y is brought to a particular development position where the electrostatic image is visualized (developed) by the developing device 4Y.

The developing device 4Y contains, for example, a yellow toner. The yellow toner is charged to the same polarity (negative) as the photoreceptor 1Y by friction as it is stirred inside the developing device 4Y. The charged yellow toner is carried by a developer roller (developer carrier). As the surface of the photoreceptor 1Y passes through the developing device 4Y, the yellow toner is electrostatically attracted to the latent image, which is neutral, on the surface of the photoreceptor 1Y. The yellow toner thus develops the latent image. The photoreceptor 1Y carrying the yellow toner image rotates at a particular speed to transport the toner image developed on the photoreceptor 1Y to a particular first transfer position.

When the yellow toner image on the photoreceptor 1Y is transported to the first transfer position, a particular first transfer bias is applied to the first transfer roller 5Y. The toner image is transferred from the photoreceptor 1Y to the intermediate transfer belt 20 by electrostatic force acting from the photoreceptor 1Y toward the first transfer roller 5Y. The transfer bias applied has the opposite polarity (positive) to the toner (negative). The transfer bias is controlled to, for example, about +10 μA in the first unit 10Y by the controller (not shown).

The cleaning device 6Y removes and collects residual toner from the photoreceptor 1Y.

The controller similarly controls the first transfer biases applied to the first transfer rollers 5M, 5C, and 5K of the second to fourth units 10M, 10C, and 10K.

Thus, the intermediate transfer belt 20 having the yellow toner image transferred thereto by the first unit 10Y is sequentially transported through the second to fourth units 10M, 10C, and 10K, which superimpose toner images of the respective colors on top of each other.

The second unit 10M includes a photoreceptor 1M that is surrounded by a charging roller 2M and a photoreceptor-cleaning device (cleaning unit) 6M. The exposure device 3 exposes the charged surface to a laser beam 3M. The third unit 10C includes a photoreceptor 1C that is surrounded by a charging roller 2C and a photoreceptor-cleaning device (cleaning unit) 6C. The exposure device 3 exposes the charged surface to a laser beam 3C. The fourth unit 10K includes a photoreceptor 1K that is surrounded by a charging roller 2K and a photoreceptor-cleaning device (cleaning unit) 6K. The exposure device 3 exposes the charged surface to a laser beam 3K.

The intermediate transfer belt 20, having the toner images of the four colors superimposed thereon through the first to fourth units 10Y, 10M, 10C, and 10K, reaches a second transfer section. The second transfer section includes the intermediate transfer belt 20, the support roller 24 disposed in contact with the inner surface of the intermediate transfer belt 20, and a second transfer roller (second transfer unit) 26 disposed on the image carrier side of the intermediate transfer belt 20.

A recording medium P is fed into a nip between the second transfer roller 26 and the intermediate transfer belt 20 at a particular timing by a feed mechanism. A particular second transfer bias is applied to the support roller 24. The transfer bias applied has the same polarity (negative) as the toner (negative). The toner image is transferred from the intermediate transfer belt 20 to the recording medium P by electrostatic force acting from the intermediate transfer belt 20 toward the recording medium P. The second transfer bias is determined depending on the resistance detected by a resistance detector (not shown) that detects the resistance of the second transfer section, and the voltage is controlled accordingly.

The recording medium P is transported to a fixing device (fixing unit) 28. The fixing device 28 fixes the toner images to the recording medium P by fusing together the superimposed toner images with heat. The recording medium P having the color image fixed thereto is transported to an eject section. Thus, the color-image forming operation is complete.

EXAMPLES

The present invention is further illustrated by the following non-limiting examples, where percentages are by mass unless otherwise indicated.

Example 1

Preparation of Coating Solution for Forming Substrate Layer

To an N-methyl-2-pyrrolidone (NMP) solution of a polyamic acid of biphenyltetracarboxylic dianhydride (BPDA) and p-phenylenediamine (PDA) (U Imide KX from Unitika Ltd.; solid content: 20% by mass) is added 18% by mass (solid content) of carbon black (Special Black 4 from Evonik Degussa Japan Co., Ltd.). The mixture is subjected to dispersion treatment (200 N/mm$^2$, five passes) using a jet mill (Geanus PY from Geanus).

The resulting carbon-black-dispersed polyamic acid solution is passed through a 20 μm stainless steel mesh to remove foreign matter and aggregated carbon black. The solution is vacuum-degassed with stirring for 15 minutes to yield a final solution. Thus, a coating solution for forming a substrate layer (solid content: 25% by mass)) is obtained.

Preparation of Coating Solution for Forming Hemispherical Protrusions

A coating solution for forming hemispherical protrusions is prepared as follows.

An NMP solution of a fluorinated polyamic acid (solid content: 20% by mass) is prepared from 1,4-bis(3,4-dicarboxytrifluorophenoxy)tetrafluorobenzene dianhydride (10FEDA) and 1,3-diamino-2,4,5,6-tetrafluorobenzene (4FMPD). To the solution is added 10% by mass (solid content) of carbon black (Special Black 4 from Evonik Degussa Japan Co., Ltd.). The mixture is subjected to dispersion treatment (200 N/mm$^2$, five passes) using a jet mill (Geanus PY from Geanus).

Thus, an NMP solution containing 90% by mass of fluorinated polyimide and 10% by mass of carbon black (dispersion, solid content: 10%) is obtained.

Fabrication of Endless Belt

A stainless steel (SUS304) cylinder having an outer diameter of 927 mm, a wall thickness of 8 mm, and a length of 900 mm is provided. Discs of the same material are also provided as retaining plates. The discs have a thickness of 8 mm and an outer diameter appropriate for fitting into the cylinder and have four air vents having a diameter of 150 mm. The discs are fitted into both ends of the cylinder and are welded together to form a core. The outer surface of the core is roughened to a roughness Ra of 0.4 μm by blasting with alumina particles.

A silicone release agent (SEPA-COAT from Shin-Etsu Chemical Co., Ltd.) is applied to the outer surface of the core and is baked at 300° C. for one hour.

The coating solution for forming a substrate layer is applied to the outer surface of the core to form a coating.

The coating solution for forming a substrate layer is applied by spiral coating.

The coating conditions are as follows. The coating solution for forming a substrate layer is ejected onto the core at 25 mL/min from a nozzle of a dispenser while rotating the core at 20 rpm. The dispenser includes a container containing 15 L of the coating solution for forming a substrate layer and a Mohno pump coupled thereto. After the ejected coating solution for forming a substrate layer is deposited on the core, a blade is put into contact with the surface of the coating and is moved at a speed of 80 mm/min in the axial direction of the core. The blade is a stainless steel plate having a thickness of 0.2 mm, a width of 20 mm, and a length of 50 mm. The coating width extends from a position 10 mm from one end of the core to a position 10 mm from the other end of the core in the axial direction. After coating, the core is rotated for additional five minutes to eliminate spiral streaks from the surface of the coating.

Thus, a coating of the coating solution for forming a substrate layer is formed. The coating has a thickness of 200 μm, which is equivalent to a finished thickness of 40 μm.

The core is placed in a drying furnace at 200° C. while being rotated at 10 rpm to dry the coating of the coating solution for forming a substrate layer for 40 minutes. Thus, a film that is to form the substrate layer is formed.

The coating solution for forming hemispherical protrusions is ejected onto the outer surface of the film that is to form the substrate layer by an inkjet process to form protrusions.

Specifically, a continuous inkjet apparatus having orifices with a diameter of 2 μm is used. As shown in FIG. 4, the coating solution for forming hemispherical protrusions is ejected as droplets having a volume of 0.3 to 3 pL onto the dry film that is to form the substrate layer on the core. During the process, the core is rotated, and the inkjet apparatus is moved in the axial direction of the core. The direction in which the orifices are arranged is inclined relative to the axis of the core. The ejection region extends from a position 10 mm from one end of the core to a position 10 mm from the other end of the core in the axial direction.

Thus, films of the coating solution for forming hemispherical protrusions are arranged in a spiral pattern at a pitch of about 5 μm on the dry film that is to form the substrate layer. These films have a hemispherical shape with a height of about 0.2 to about 2 μm.

The core is removed from a rotating support, is placed in a vertical position in a heating furnace, and is heated at 250° C. for 60 minutes to simultaneously facilitate evaporation of residual solvent off the substrate layer and the protrusions and imidation reaction.

The resulting resin film, which is composed of the substrate layer and the hemispherical protrusions, is removed from the core. Thus, an endless belt is obtained.

The endless belt is cut in the center thereof in the width direction and is then cut at both ends thereof to remove unnecessary portions. Thus, two endless belts having a width of 360 mm are obtained. The thickness of the endless belts is measured at 5 locations in the axial direction and 10 locations in the circumferential direction, namely, a total of 50 locations, using a dial gauge. The average thickness is 80 μm.

Surface examination of the endless belts shows that hemispherical protrusions having a height of about 0.8 μm and a diameter of 2 μm are formed at a pitch of 5 μm on the substrate layer.

Example 2

An endless belt is fabricated as in Example 1 except that the coating solution for forming hemispherical protrusions is prepared by diluting the coating solution for forming a substrate layer with NMP to a solid content of 10%.

Example 3

An endless belt is fabricated as in Example 1 except that the polyimide resin used for the coating solution for forming a substrate layer is replaced by a polyamideimide resin.

A coating solution for forming a substrate layer containing a polyamideimide resin is prepared as follows.

To a solvent-soluble polyamideimide resin (Tg: 282° C.; number average molecular weight: 29,000; solid content: 20% by mass; solvent: NMP) is added 18% by mass (solid content) of carbon black (Special Black 4 from Evonik Degussa Japan Co., Ltd.). The mixture is subjected to dispersion treatment (200 N/mm$^2$, five passes) using a jet mill (Geanus PY from Geanus).

The resulting carbon-black-dispersed polyamideimide resin solution is passed through a 20 μm stainless steel mesh to remove foreign matter and aggregated carbon black. The solution is vacuum-degassed with stirring for 15 minutes to yield a final solution. Thus, a coating solution for forming a substrate layer (solid content: 25% by mass)) is obtained.

Example 4

An endless belt is fabricated as in Example 1 except that the fluorinated polyamic acid contained in the NMP solution used as the coating solution for forming hemispherical protrusions is replaced by a thermosetting fluoropolymer resin (fluoroolefin-vinyl ether copolymer available under the trade name OPSTAR JN7215 from JSR Corporation).

Example 5

An endless belt is fabricated as in Example 1 except that the coating solution for forming hemispherical protrusions contains 18% by mass (solid content) of carbon black.

Example 6

An endless belt is fabricated as in Example 1 except that hemispherical protrusions having a height of about 3 μm and a diameter of 8 μm are formed at a pitch of 16 μm on the substrate layer.

Comparative Example 1

A coating solution for forming a surface layer is prepared as in the preparation of the coating solution for forming a substrate layer in Example 1 except that it contains 90% by mass of a polyimide resin and 10% by mass of carbon black based on the total solid content.

After the substrate layer is formed as in Example 1, the coating solution for forming a surface layer is applied to a thickness of 10 μm on the substrate layer by flow coating.

The core is removed from a rotating support, is placed in a vertical position in a heating furnace, and is heated at 250° C. for 60 minutes to simultaneously facilitate evaporation of residual solvent off the substrate layer and the surface layer and imidation reaction.

After the imidation reaction, the resulting resin film, which is composed of the substrate layer and the surface layer, is removed from the core. Thus, an endless belt is obtained.

Comparative Example 2

An endless belt is fabricated as in Example 1 except that, after the substrate layer is formed as in Example 1, the coating solution for forming hemispherical protrusions used in Example 1 is applied to a thickness of 10 μm on the substrate layer by flow coating, i.e., without forming hemispherical protrusions (droplets).

Table 1 summarizes the endless belts fabricated in the Examples and Comparative Examples.

Preparation of Developer

Developer 1 is prepared for evaluation as follows.

Preparation of Polyester Resin (A1) and Polyester Resin Particle Dispersion (a1)

In a two-necked flask dried by heating are placed 15 molar parts of polyoxyethylene(2,0)-2,2-bis(4-hydroxyphenyl)propane, 85 molar parts of polyoxypropylene(2,2)-2,2-bis(4-hydroxyphenyl)propane, 10 molar parts of terephthalic acid, 67 molar parts of fumaric acid, 3 molar parts of n-dodecenylsuccinic acid, 20 molar parts of trimellitic acid, and dibutyltin oxide in an amount of 0.05 molar part based on the amount of acid components (the total molar parts of terephthalic acid, n-dodecenylsuccinic acid, trimellitic acid, and fumaric acid). The flask is purged with nitrogen to maintain an inert atmosphere and is heated to and maintained at 150° C. to 230° C. for 12 to 20 hours to facilitate condensation copolymerization. The inner pressure is then gradually reduced at 210° C. to 250° C. Thus, polyester resin (A1) is synthesized. Polyester resin (A1) has a weight average molecular weight Mw of 65,000 and a glass transition temperature Tg of 65° C.

In an emulsification tank of a high-temperature, high-pressure emulsification system (Cavitron CD1010 from Eurotec, Ltd; slit: 0.4 mm) are placed 3,000 parts by mass of polyester resin (A1), 10,000 parts by mass of ion exchange water, and 90 parts by mass of sodium dodecylbenzenesulfonate, as a surfactant. The mixture is heated to and melted at 130° C. and is dispersed at 110° C., a flow rate of 3 L/m, and a rotational speed of 10,000 rpm for 30 minutes. The resulting dispersion is passed through a cooling tank to yield an amorphous resin particle dispersion. Thus, polyester resin particle dispersion (a1) is obtained.

Preparation of Polyester Resin (B1) and Polyester Resin Particle Dispersion (b1)

In a three-necked flask dried by heating are placed 45 molar parts of 1,9-nonanediol; 55 molar parts of dodecanedicarboxylic acid, and 0.05 molar part of dibutyltin oxide, as a catalyst. The flask is purged with nitrogen gas under reduced pressure to form an inert atmosphere therein. The mixture is mechanically stirred at 180° C. for two hours. The mixture is then gradually heated to 230° C. under reduced pressure and is stirred for five hours. When the mixture becomes viscous,

TABLE 1

| | Substrate layer | | Surface layer | | Protrusions | | | |
|---|---|---|---|---|---|---|---|---|
| | Resin | Conductor content (%) | Resin | Conductor content (%) | Resin | Conductor content (%) | Shape | Pitch (μm) |
| Example 1 | Polyimide | 18 | — | — | Fluorinated Polyimide | 10 | Hemispherical | 5 |
| Example 2 | Polyimide | 18 | — | — | Polyimide | 10 | Hemispherical | 5 |
| Example 3 | Polyamideimide | 18 | — | — | Fluorinated Polyimide | 10 | Hemispherical | 5 |
| Example 4 | Polyimide | 18 | — | — | OPSTAR JN7215 | 10 | Hemispherical | 5 |
| Example 5 | Polyimide | 18 | — | — | Fluorinated Polyimide | 18 | Hemispherical | 5 |
| Example 6 | Polyimide | 18 | — | — | Fluorinated Polyimide | 10 | Hemispherical | 16 |
| Comparative Example 1 | Polyimide | 18 | Polyimide | 10 | — | — | — | — |
| Comparative Example 2 | Polyimide | 18 | Fluorinated Polyimide | 10 | — | — | — | — |

it is cooled with air to terminate the reaction. Thus, polyester resin (B1) is synthesized. Polyester resin (B1) has a weight average molecular weight Mw of 25,000 and a melting temperature Tm of 73° C.

Polyester resin dispersion (b1) is prepared using a high-temperature, high-pressure emulsification system (Cavitron CD1010 from Eurotec, Ltd; slit: 0.4 mm) under the same conditions as the polyester resin dispersion (a1).

Preparation of Colorant Particle Dispersion

Cyan pigment (Pigment Blue 15:3 (copper phthalocyanine) from Dainichiseika Color & Chemicals Mfg. Co., Ltd.): 1,000 parts by mass Anionic surfactant (Neogen SC from Dai-Ichi Kogyo Seiyaku Co., Ltd.): 150 parts by mass Ion exchange water: 4,000 parts by mass The materials listed above are mixed and dissolved. The mixture is dispersed for one hour using a high-pressure impact disperser (Ultimaizer HJP30006 from Sugino Machine Limited). Thus, a colorant particle dispersion containing colorant (cyan pigment) particles is obtained. The colorant (cyan pigment) particles contained in the colorant particle dispersion have a volume average particle size of 0.15 μm and a colorant particle concentration of 20%.

Preparation of Release Agent Particle Dispersion

Wax (WEP-2 from NOF Corporation): 100 parts by mass

Anionic surfactant (Neogen SC from Dai-Ichi Kogyo Seiyaku Co., Ltd.): 2 parts by mass Ion exchange water: 300 parts by mass Fatty acid amide wax (NEUTRON-D from Nippon Fine Chemical Co., Ltd.): 100 parts by mass Anionic surfactant (NEUREX R from NOF Corporation): 2 parts by mass The materials listed above are heated to 95° C., are dispersed using a homogenizer (ULTRA-TURRAX T50 from IKA), and are dispersed using a Gaulin high-pressure homogenizer (from Gaulin). Thus, release agent particle dispersion (1) is obtained, which contains release agent particles having a volume average particle size of 200 nm (release agent concentration: 20% by mass).

Preparation of Toner Particles 1

Polyester resin particle dispersion (a1): 340 parts by mass

Polyester resin particle dispersion (b1): 160 parts by mass

Colorant particle dispersion: 50 parts by mass

Release agent particle dispersion: 60 parts by mass

Surfactant aqueous solution: 10 parts by mass 0.3 M nitric acid aqueous solution: 50 parts by mass Ion exchange water: 500 parts by mass The materials listed above are placed in a stainless steel round flask and are dispersed using a homogenizer (ULTRA-TURRAX T50 from IKA). The dispersion is heated to and maintained at 42° C. in a heating oil bath for 30 minutes and is then heated to and maintained at 58° C. in the heating oil bath for 30 minutes. When it is determined that aggregate particles are formed, 100 parts by mass of polyester resin particle dispersion (a1) are added, and the dispersion is maintained for additional 30 minutes.

Sodium nitrilotriacetate (Chelest 70 from Chelest Corporation) is then added in an amount of 3% of the total amount of solution. A 1 N sodium hydroxide aqueous solution is gently added to a pH of 7.2. With continued stirring, the solution is heated to and maintained at 85° C. for three hours. The reaction product is filtered out, is washed with ion exchange water, and is dried using a vacuum dryer. Thus, toner particles 1 are obtained.

Particle size measurement using Coulter Multisizer shows that toner particles 1 has a volume average particle size D50 of 4.5 μm and a particle size distribution coefficient GSD of 1.22.

Preparation of Toner 1

To 100 parts by mass of toner particles 1, 3 parts by mass of silica particles (Fumed Silica RX50 from Nippon Aerosil Co., Ltd.; volume average particles size: 40 nm) is added. The mixture is stirred at a peripheral velocity of 30 m/s using a 5 L Henschel mixer for 15 minutes. The mixture is passed through a 45 μm sieve to remove coarse particles. Thus, toner 1 is obtained.

Preparation of Developer 1

In a pressure kneader are placed 100 parts of ferrite particles (from Powdertech Co., Ltd.; average particle size: 50 μm), 1.5 parts of a methyl methacrylate resin (from Mitsubishi Rayon Co., Ltd.; molecular weight: 95,000; content of molecules with molecular weights of 10,000 or less: 5%), and 500 parts of toluene. The mixture is stirred at room temperature for 15 minutes. The mixture is then heated to 70° C. with stirring under reduced pressure to remove toluene. After cooling, the mixture is passed through a 105 μm sieve to obtain a resin-coated ferrite carrier.

Toner 1 is mixed with the resin-coated ferrite carrier to prepare developer 1 (two-component electrostatic image developer), which has a toner concentration of 7% by weight.

Evaluations

As an intermediate transfer image-forming apparatus, a modified Color 1000 Press printer (from Fuji Xerox Co., Ltd.) is provided by detaching a scraper from a cleaning device for an intermediate transfer belt and attaching a cleaning brush.

Developer 1 is charged into a developing device, and the endless belt fabricated in Example 1 is mounted as an intermediate transfer belt. The intermediate transfer image-forming apparatus includes a doctor blade as a cleaning blade for the intermediate transfer belt.

The endless belt is evaluated for the following items (1) to (5).

The endless belts fabricated in the other Examples and Comparative Examples are also evaluated. The results are summarized in Table 2.

(1) Initial Transfer Efficiency of Intermediate Transfer Belt

The initial transfer efficiency is evaluated. Specifically, an image including cyan solid (100% density) 3 cm×3 cm patches is produced. The apparatus is brought to a sudden stop during the second transfer step. The weight a of toner on the intermediate transfer belt before the second transfer and the weight b of toner remaining thereon after the second transfer are measured. The transfer efficiency is determined by equation (7):

$$\text{Transfer efficiency } \eta\ (\%)=(a-b)/a\times 100$$

The transfer efficiency is evaluated according to the following criteria:

A: 95% or more

B: More than 90% and less than 95%

C: 90% or less (2) Transfer Performance for Rough Paper (Visual Inspection)

A solid image is formed on rough paper to determine whether the developer is successfully transferred to the recesses on the paper. Specifically, an image including cyan solid (100% density) 3 cm×3 cm patches is produced. The resulting image is visually inspected to determine whether the developer is successfully transferred to the recesses on the paper.

The transfer performance is evaluated according to the following criteria:

A: No transfer detects

B: Slight transfer detects

C: Noticeable transfer detects (3) Transfer Efficiency for Small-Sized Toner After Formation of Images on 500,000 Sheets The transfer efficiency after repeated image formation is evaluated. Specifically, the transfer efficiency is evaluated in the same manner as (1) the initial transfer efficiency of the intermediate transfer belt.

The transfer efficiency is evaluated according to the following criteria:

A: 95% or more

B: More than 90% and less than 95%

C: 90% or less (4) Condition of Protrusions after Formation of Images on 500,000 Sheets (under SEM)

The condition of the hemispherical protrusions after repeated image formation is evaluated. Specifically, 100 protrusions are examined in a 10,000× secondary electron image under a JEOL JSM-6700F SEM at an acceleration voltage of 5 kV, and the percentage of the remaining protrusions is calculated.

The percentage of the remaining protrusions is evaluated according to the following criteria:

A: 80% or more

B: More than 50% and less than 80%

C: 50% or less (5) Condition of Protrusions after Formation of Images on 1,000,000 Sheets (Under SEM)

The condition of the hemispherical protrusions after further repeated image formation is evaluated. Specifically, the condition of the hemispherical protrusions is evaluated in the same manner as (4) the condition of the hemispherical protrusions after the formation of images on 500,000 sheets.

TABLE 2

| | Transfer efficiency of small-sized toner | Transfer performance for rough paper (visual inspection) | Transfer efficiency for small-sized toner after formation of images on 500,000 sheets | Condition of protrusions after formation of images on 500,000 sheets (under SEM) | Condition of protrusions after formation of images on 1,000,000 sheets (under SEM) |
|---|---|---|---|---|---|
| Example 1 | A | A | A | A | A |
| Example 2 | B | A | B | A | A |
| Example 3 | A | A | B | B | B |
| Example 4 | A | A | B | B | B |
| Example 5 | B | A | B | A | A |
| Example 6 | A | B | B | B | B |
| Comparative Example 1 | C | C | C | — | — |
| Comparative Example 2 | B | C | B | — | — |

Example 1, in which the hemispherical protrusions are formed of a fluoropolymer resin, shows high transfer efficiency for small-sized toner, high transfer performance for rough paper, and high long-term durability.

Example 2, in which the hemispherical protrusions contain no fluoropolymer resin, shows a slightly lower transfer efficiency, but shows high transfer performance for rough paper.

Example 3, in which the substrate layer is formed of a thermoplastic resin, shows high transfer performance, although some protrusions are lost.

Example 4, in which the hemispherical protrusions are formed of a thermoplastic resin other than fluorinated polyimide, shows high transfer performance, although some protrusions are lost.

Example 5, in which the content of carbon black in the protrusions is not lower than the content of carbon black in the resin layer, shows a slightly lower transfer efficiency, but shows high transfer performance for rough paper.

Example 6, in which the pitch of the hemispherical protrusions is larger than the particle size of the small-sized toner, shows a slightly lower transfer efficiency, but shows a higher transfer performance for rough paper than an endless belt having no hemispherical protrusions.

Comparative Examples 1 and 2, in which a smooth film is formed, shows low transfer performance for rough paper, irrespective of whether the resin is fluorinated.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An endless belt for an image-forming apparatus, comprising, as an outermost layer, a resin layer having substantially hemispherical protrusions distributed over an outer surface thereof, wherein the resin layer and the hemispherical protrusions contain carbon black, the protrusions having a lower carbon black content (% by mass) than the resin layer.

2. The endless belt according to claim 1, wherein the hemispherical protrusions contain a fluoropolymer resin.

3. The endless belt according to claim 2, wherein the fluoropolymer resin is a fluorinated polyimide.

4. The endless belt according to claim 3, wherein the resin layer contains a thermosetting resin.

5. The endless belt according to claim 2, wherein the resin layer contains a thermosetting resin.

6. The endless belt according to claim 1, wherein the resin layer contains a thermosetting resin.

7. An endless belt unit attachable to and detachable from an image-forming apparatus, the endless belt unit comprising:

the endless belt according to claim 1; and a plurality of rollers about which the endless belt is entrained under tension.

8. An image-forming apparatus comprising:

an image carrier having a surface;

a charging unit that charges the surface of the image carrier;

a latent-image forming unit that forms an electrostatic latent image on the charged surface of the image carrier;

a developing unit that contains a developer containing toner particles and that develops the electrostatic latent image on the surface of the image carrier with the developer to form a toner image;

the endless belt according to claim 1, the toner image being transferred from the surface of the image carrier to the outer surface of the endless belt;

a first transfer unit that transfers the toner image from the surface of the image carrier to the outer surface of the endless belt;

a second transfer unit that transfers the toner image from the outer surface of the endless belt to a recording medium; and a fixing unit that fixes the toner image to the recording medium.

9. A method for forming an image, comprising:

charging a surface of an image carrier;

forming an electrostatic latent image on the charged surface of the image carrier;

developing the electrostatic latent image on the surface of the image carrier with a developer containing toner particles to form a toner image;

transferring the toner image from the surface of the image carrier to the outer surface of the endless belt according to claim 1;

transferring the toner image from the outer surface of the endless belt to a recording medium; and fixing the toner image to the recording medium.

* * * * *